US011851852B2

(12) United States Patent
Kozui et al.

(10) Patent No.: US 11,851,852 B2
(45) Date of Patent: Dec. 26, 2023

(54) CONSTRUCTION MACHINE AND EVALUATION DEVICE

(71) Applicants: KOBELCO CONSTRUCTION MACHINERY CO., LTD., Hiroshima (JP); HIROSHIMA UNIVERSITY, Higashi-Hiroshima (JP)

(72) Inventors: Masatoshi Kozui, Hiroshima (JP); Toru Yamamoto, Hiroshima (JP); Kazushige Koiwai, Hiroshima (JP)

(73) Assignees: KOBELCO CONSTRUCTION MACHINERY CO., LTD., Hiroshima (JP); HIROSHIMA UNIVERSITY, Higashi-Hiroshima (JP)

( * ) Notice: Subject to any disclaimer, the term of this patent is extended or adjusted under 35 U.S.C. 154(b) by 377 days.

(21) Appl. No.: 17/270,686

(22) PCT Filed: Aug. 29, 2019

(86) PCT No.: PCT/JP2019/033952

§ 371 (c)(1),
(2) Date: Feb. 23, 2021

(87) PCT Pub. No.: WO2020/045577

PCT Pub. Date: Mar. 5, 2020

(65) Prior Publication Data

US 2021/0340736 A1 Nov. 4, 2021

(30) Foreign Application Priority Data

Aug. 31, 2018 (JP) ..... 2018-163171

(51) Int. Cl.

| | |
|---|---|
| ***E02F 9/26*** | (2006.01) |
| ***E02F 3/32*** | (2006.01) |
| ***E02F 3/43*** | (2006.01) |

(52) U.S. Cl.
CPC ..... *E02F 9/264* (2013.01); *E02F 3/32* (2013.01); *E02F 3/435* (2013.01)

(58) Field of Classification Search
CPC ... E02F 3/32; E02F 3/435; E02F 9/264; E02F 9/267
See application file for complete search history.

(56) References Cited

U.S. PATENT DOCUMENTS 5,999,872 A * 12/1999 Kinugawa ..... E02F 9/2025 172/4
11,041,288 B2 * 6/2021 Hiromatsu ..... E02F 9/20
(Continued)

FOREIGN PATENT DOCUMENTS

| | | |
|---|---|---|
| JP | 5-52608 A | 3/1993 |
| JP | 2001-142506 A | 5/2001 |
| JP | 2018-135681 A | 8/2018 |

OTHER PUBLICATIONS

International Search Report dated Nov. 5, 2019 in PCT/JP2019/033952 filed Aug. 29, 2019, 2 pages.
(Continued)

*Primary Examiner* — Tyler J Lee
(74) *Attorney, Agent, or Firm* — Oblon, McClelland, Maier & Neustadt, L.L.P.

(57) ABSTRACT

A construction machine includes: a lower travelling body; an upper slewing body attached to the lower travelling body with a structure allowing the upper slewing body to slew with respect to the lower travelling body; a work device attached to the upper slewing body with a structure allowing the work device to swing in a vertical direction with respect to the upper slewing body; a motion state acquisition unit acquiring a motion state amount; an equivalent system forming unit which forms a transfer function which uses a driving force for moving the work device as an input and uses the motion state amount as an output as an equivalent
(Continued)

system which equivalently expresses an operation of the work device; and a parameter estimation unit which estimates a system attenuation coefficient and a natural angular frequency of the transfer function as an operation skill evaluation value.

5 Claims, 19 Drawing Sheets

(56) References Cited

U.S. PATENT DOCUMENTS

| | | | | |
|---|---|---|---|---|
| 2003/0001750 | A1* | 1/2003 | Ishimoto | G06F 3/048 340/425.5 |
| 2003/0097925 | A1 | 5/2003 | Koehler et al. | |
| 2013/0158787 | A1* | 6/2013 | Nomura | E02F 9/26 701/34.4 |
| 2016/0247332 | A1 | 8/2016 | Egawa | |
| 2017/0089043 | A1 | 3/2017 | Chang et al. | |
| 2019/0218749 | A1 | 7/2019 | Hiromatsu et al. | |
| 2019/0241124 | A1* | 8/2019 | Izumikawa | B60R 11/04 |

OTHER PUBLICATIONS

Koiwai, K., "A Study on Evaluations of the Behavior and Operational Skills for an Excavator Based on the Control Engineering Approach", The thesis of Graduate School of Engineering, Hiroshima University (doctoral), Degree record No. A7596, 2018, 30 total pages with Partial English Translation).

Yokota, S., et al., "Robust Trajectory Control of 3-axis Arm Systems of Hydraulic Excavators (The Effectiveness ofthe Control Using Disturbance Observer)", Transactions ofthe Japan Society of Mechanical Engineers Series C, vol. 66, No. 648, 2000, pp. 2549-2556.

Yoshida, T., et al., "Examination of Effective Improvement in Digging Operation for Hydraulic Excavators", Transactions of the Japan Society of Mechanical Engineers Series C, vol.78, No. 789,2012, pp. 1596-1606.

Sakaida, Y., et al., "The Analysis of Skillful Hydraulic Excavator Operation", 23rd Japan Robotics Society Technical Lecture, vol. 23, 2005, p. 3121, 5 total pages.

Extended European Search Report dated Oct. 1, 2021 in European Patent Application No. 19856004.7, 5 pages.

* cited by examiner

FIG. 16

| | SUDDEN STOP |
|---|---|
| $\zeta$ | 0.200 |
| $\omega_n$ | 8.50 |

FIG. 17

| | INDEX VALUE | Expert | Non-expert1 | Non-expert2 | Non-expert3 | Non-expert4 |
|---|---|---|---|---|---|---|
| $\zeta$ | 0.707 | 0.719 | 0.174 | 0.300 | 0.265 | 0.386 |
| $\omega_n$ | 8.50 | 5.90 | 3.27 | 2.52 | 2.83 | 2.71 |

CONSTRUCTION MACHINE AND EVALUATION DEVICE

TECHNICAL FIELD

The present invention relates to a technique for evaluating an operation skill of an operator who operates a construction machine.

BACKGROUND ART

Recently, in the construction industry, an amount of investment on construction has been decreasing. Further, a percentage of young people engaging in such construction industry has been remarkably decreasing. As a result, aging of people engaging in such construction industry has been steadily taking place. On the other hand, in such a social environment, there has been observed a move to enhance productivity by creating an attractive construction site while realizing a construction site which ensures workers to acquire high salary, to have enough holidays and to have a hope in their future. Although the enhancement of productivity and the realization of an attractive construction site are basically values which contradict with each other, there has been a demand for a construction site which satisfies both values. In various industries including, not to mention, construction industry, i-Construction has been in progress under an initiative of the nation. The i-Construction aims at the realization of both the enhancement of productivity and the creation of an attractive construction site. In the i-Construction, productivity per person is enhanced by saving man power with the use of information and communication technology (ICT) construction machines or with the introduction of automation of works.

However, in a construction site, there are still many cases where works require operations and determinations performed by human such as a case where the content of a work is not steady or a case where an environment of a construction site is not steady. In such cases, productivity of a construction machine such as a hydraulic excavator is largely influenced by a skill of an operator of the construction machine. That is, the operator needs to operate a plurality of respective operation levers of the construction machine in conformity with the environment of a construction site or the content of the work. Accordingly, a skilled operator with high skill can realize a highly productive and efficient work.

In addition, recently, the number of experienced operators has decreased because of aging of the operators, and young operators are becoming the main players. To ensure high productivity in such circumstances, it is a prerequisite to enhance an operation skill of an individual unskilled operator. However, since it takes time to enhance an operation skill of the unskilled operator, it is necessary to take various measures for increasing productivity such as a control of a construction machine.

For example, Non-Patent Literature 1 proposes a control for enhancing productivity by making an excavation trajectory of a hydraulic excavator trace a predetermined trajectory. Further, for example, Non-Patent Literature 2 reports a method of moving a bucket with a low excavation reaction force in anticipation of automation of such an excavation work in future. Further, for example, Non-Patent Literature 3 which relates to the evaluation of skill proposes a method of evaluating skill level based on irregularities in a trajectory of a distal end of a bucket during an excavation work.

Non-Patent Literature 1 and Non-Patent Literature 2 disclose techniques which relate to a control method for improving productivity during working. In Non-Patent Literature 1 and Non-Patent Literature 2, the productivity is largely influenced by a skill of an operator, that is, a quality of operation performed by the operator. In this manner, there is no description in Non-Patent Literature 1 and Non-Patent Literature 2 with respect to the evaluation of an operation skill of an operator.

Non-Patent Literature 3 discloses a technique where a skill level is evaluated based on irregularities in a trajectory of a distal end of a bucket during an excavation work. However, dynamics of the excavation work is not taken into consideration in Non-Patent Literature 3. Accordingly, so long as the trajectory traces a targeted trajectory, even when an operation is slow (even when productivity is low), it is estimated that a skill level is high. Therefore, in Non-Patent Literature 3, it is difficult to accurately evaluate an operation skill of an operator.

CITATION LIST

Patent Literature

Non-Patent Literature 1: Shinichi Yokota et al., "Robust Trajectory Control of 3-axis Arm Systems of Hydraulic Excavators—The effectiveness of the Control using Disturbance Observer", 2000, Transactions of the Japan Society of Mechanical Engineers Series C, Vol. 66, No. 648, pp. 2549-2556

Non-Patent Literature 2: Tatsuya Yoshida et al., "Examination of Effective Improvement in Digging Operation for Hydraulic Excavators", 2012, Transactions of the Japan Society of Mechanical Engineers Series C, Vol. 78, No. 789, pp. 1596-1606

Non-Patent Literature 3: Yuki Sakaida et al., "The Analysis of Skillful Hydraulic Excavator Operation", 2005, 23rd Japan Robotics Society Technical Lecture, Vol. 23, p. 3121

SUMMARY OF INVENTION

The present invention has been made to overcome the above-mentioned drawbacks, and it is an object of the present invention to provide a technique by which an operation skill of an operator can be easily and accurately evaluated.

A construction machine according to one aspect of the present invention includes: a lower travelling body; an upper slewing body attached to the lower travelling body with a structure which allows the upper slewing body to slew with respect to the lower travelling body, a work device which is attached to the upper slewing body with a structure which allows the work device to swing in a vertical direction with respect to the upper slewing body and includes a plurality of members; an acquisition unit which acquires a motion state amount of a combined center of gravity of the plurality of members; a forming unit which forms a transfer function which uses a driving force for moving the work device as an input and the motion state amount acquired by the acquisition unit as an output as an equivalent system which equivalently expresses an operation of the work device; and an estimation unit which estimates a system attenuation coefficient and a natural angular frequency of the transfer function formed by the forming unit as an operation skill evaluation value of an operator.

According to the present invention, an operation skill of an operator can be evaluated easily and accurately.

BRIEF DESCRIPTION OF DRAWINGS

FIG. 16 is a view showing a parameter table calculated from data shown in FIG. 14 and FIG. 15.

FIG. 17 is a view showing a comparison between a set index value according to the present embodiment and parameter estimation results of respective subjects shown in FIG. 11.

DESCRIPTION OF EMBODIMENTS

Hereinafter, a construction machine according to an embodiment of the present invention is described with reference to drawings. The embodiment described hereinafter is an example which embodies the present invention, and is not intended to limit the technical scope of the present invention.

Figure 1:
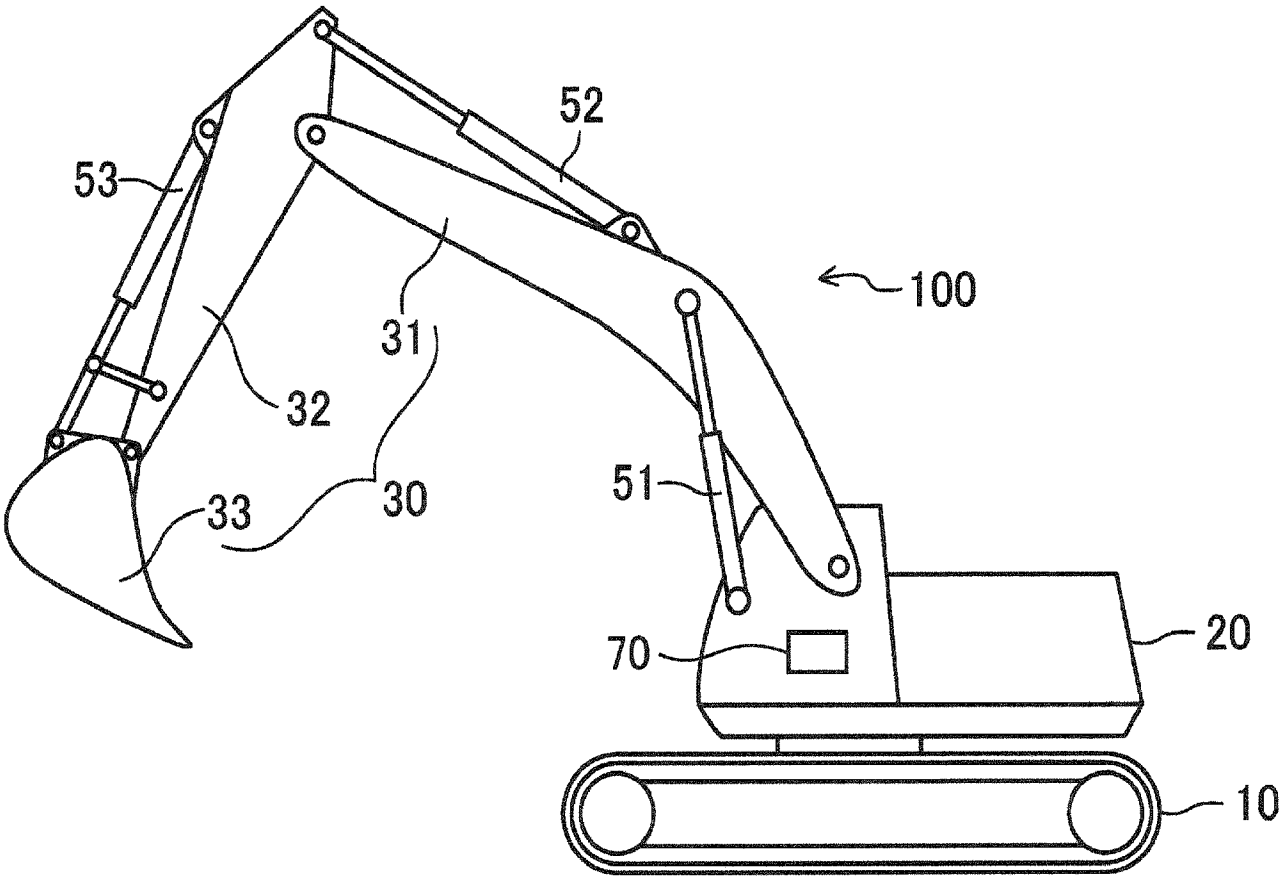
FIG. 1 is a side view showing an example of a construction machine according to the present embodiment.

FIG. 1 is a side view showing an example of a construction machine according to the present embodiment.

As shown in FIG. 1, a construction machine 100 includes a lower travelling body 10, an upper slewing body 20 mounted on the lower travelling body 10 with a structure which allows the upper slewing body 20 to slew with respect to the lower travelling body 10, and a work device 30 mounted on the upper slewing body 20 with a structure which allows the work device 30 to swing in a vertical direction with respect to the upper slewing body 20. The work device 30 includes a plurality of driven members (a boom 31, an arm 32, and a bucket 33) which respectively rotate in a vertical direction. The plurality of driven members are connected to each other. A proximal end of the boom 31 of the work device 30 is supported on a front portion of the upper slewing body 20.

The boom 31, the arm 32 and the bucket 33 are respectively driven by a boom cylinder 51, an arm cylinder 52 and a bucket cylinder 53. Operation instructions to the boom cylinder 51, the arm cylinder 52, and the bucket cylinder 53 are outputted in response to an operation performed by an operator with respect to a plurality of operation levers (not shown) mounted in a cab on the upper slewing body 20. Specifically, a hydraulic pilot type operation device (not shown) corresponding to each operation lever is disposed in the cab. The boom cylinder 51, the arm cylinder 52, and the bucket cylinder 53 extend and contract respectively by a pressurized oil supplied in response to a signal from the operation device. Accordingly, the boom 31, the arm 32, and the bucket 33 rotate respectively so as to change the position and the posture of the bucket 33.

The technical feature of the present embodiment lies in that the construction machine 100 includes the control device 70 which clearly distinguishes the difference in operation characteristics between an expert and a non-expert, easily and accurately evaluates a skill level (operation skill) of an operator, and efficiently controls the construction machine 100 based on the evaluation.

Figure 2:
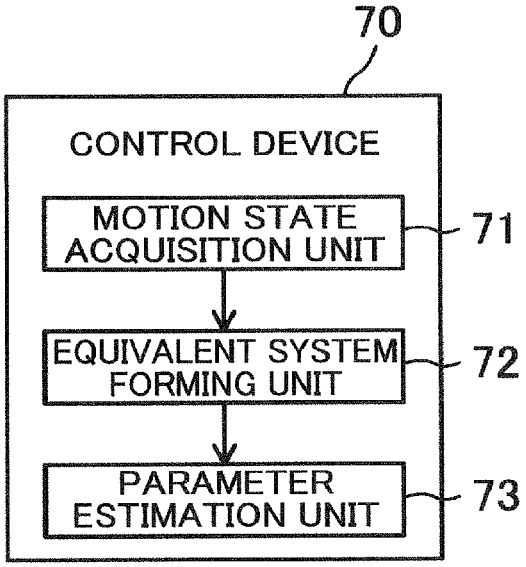
FIG. 2 is a block diagram showing a configuration of a control device according to the present embodiment.

FIG. 2 is a block diagram showing a configuration of the control device according to the present embodiment.

As shown in FIG. 2, the control device 70 includes a motion state acquisition unit 71, an equivalent system forming unit 72, and a parameter estimation unit 73. The control device 70 is an example of an evaluation device, the motion state acquisition unit 71 is an example of an acquisition unit, the equivalent system forming unit 72 is an example of a forming unit, and the parameter estimation unit 73 is an example of an estimation unit.

The motion state acquisition unit 71 acquires a motion state amount of a combined center of gravity of a plurality of members included in the work device 30. That is, the motion state acquisition unit 71 measures and calculates the motion state amount of the combined center of gravity of the work device 30 by detecting postures of the respective members using sensors mounted on the respective members (the boom 31, the arm 32 and the bucket 33) of the work device 30.

The equivalent system forming unit 72 forms a transfer function which uses a driving force for moving the work device 30 as an input and a motion state amount acquired by the motion state acquisition unit 71 as an output as an equivalent system which equivalently expresses the motion of the work device 30.

The parameter estimation unit 73 estimates parameters of the transfer function formed by the equivalent system forming unit 72 as operation skill evaluation values of the operator. The parameters include a system attenuation coefficient and a natural angular frequency.

According to the present embodiment described above, the work device 30 formed of a plurality of members (attachments) can be treated as an equivalent system in which the motion of the work device 30 is equivalently expressed only by the combined center of gravity of the plurality of attachments. Accordingly, the number of parameters which are to be used in evaluating characteristics of an operation of an operator or an operation skill of the operator can be reduced so that the operation skill of the operator can be easily evaluated. Further, the characteristic amount of the operation of the operators can be obtained from the parameters of the transfer function of the equivalent system and hence, the difference in skill level between the operators, that is, the operation skill can be quantitatively evaluated. Specifically, an attenuation characteristic (a degree of an overshoot) can be quantitatively evaluated based on a system attenuation coefficient which forms a transfer function of an equivalent system. Further, a speed responsiveness (work speed) can be quantitatively evaluated based on a natural angular frequency which forms a transfer function of an equivalent system.

Figure 3:
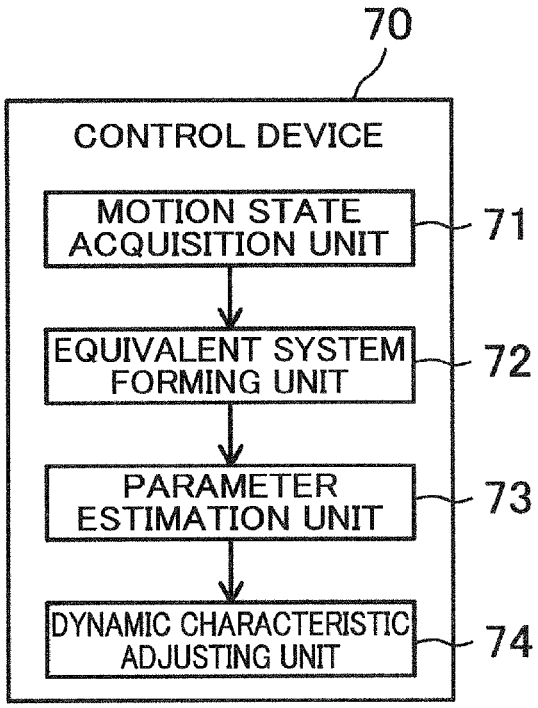
FIG. 3 is a block diagram showing a configuration of a control device according to a modification of the present embodiment.

FIG. 3 is a block diagram showing a configuration of a control device according to a modification of the present embodiment.

In the modification of the present embodiment, as shown in FIG. 3, a control device 70 may further include a dynamic characteristic adjusting unit 74 in addition to a motion state acquisition unit 71, an equivalent system forming unit 72, and a parameter estimation unit 73. The dynamic characteristic adjusting unit 74 adjusts a dynamic characteristic of the work device 30 based on the difference between an operation skill evaluation value estimated by the parameter estimation unit 73 and a preset index value. The index value can be changed according to an operation method or a work content.

Figure 4:
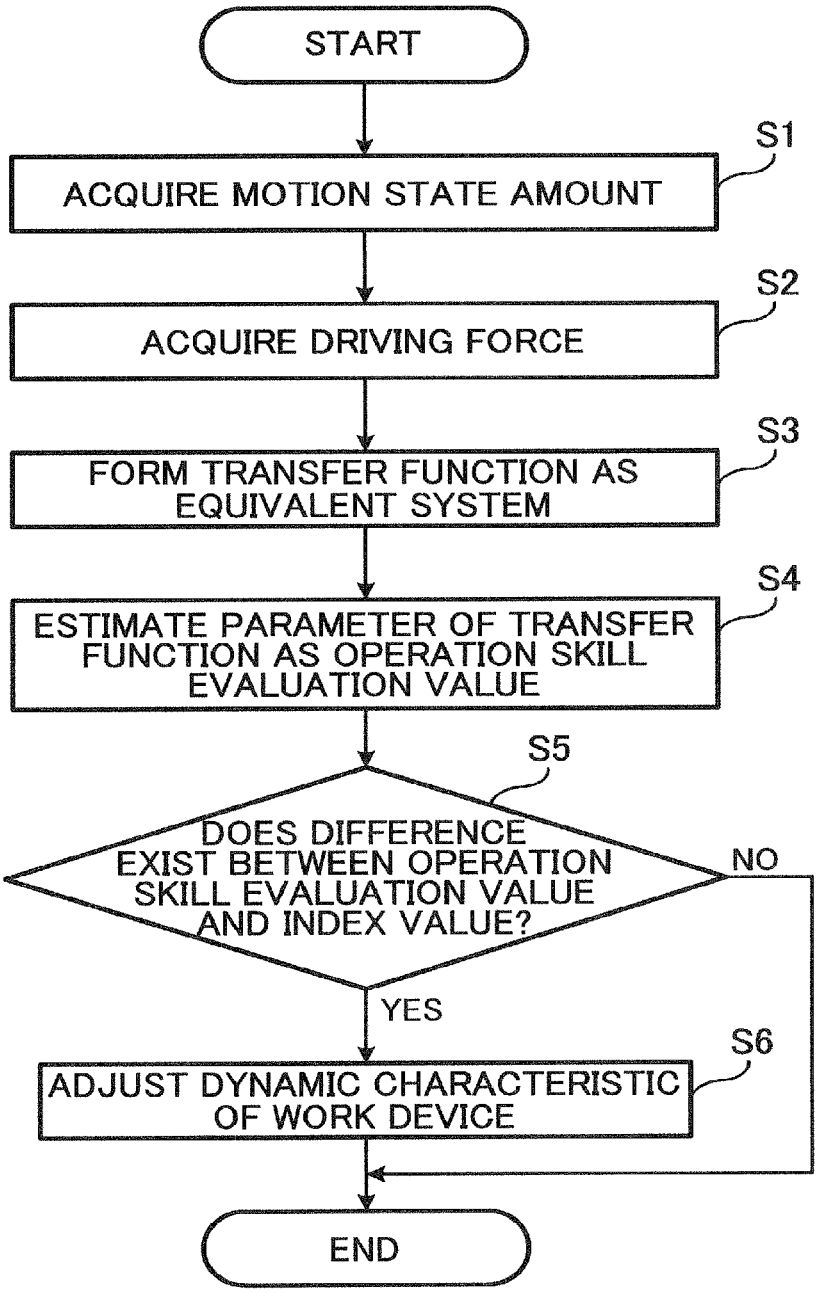
FIG. 4 is a flowchart for describing processing for controlling a work device using the control device shown in FIG. 3.

FIG. 4 is a flowchart for describing the processing for controlling the work device using the control device shown in FIG. 3.

As shown in FIG. 4, first, in step S1, the motion state acquisition unit 71 acquires a motion state amount of the combined center of gravity of the plurality of members included in the work device 30.

Next, in step S2, the equivalent system forming unit 72 acquires driving forces for moving the plurality of respective members of the work device 30.

Next, in step S3, the equivalent system forming unit 72 forms a transfer function which uses a driving force for moving the work device 30 as an input and a motion state amount acquired by the motion state acquisition unit 71 as an output as an equivalent system which equivalently expresses the motion of the work device 30.

Next, in step S4, the parameter estimation unit 73 estimates parameters of the transfer function formed by the equivalent system forming unit 72 as operation skill evaluation values of the operator. The parameters to be acquired are a system attenuation coefficient and a natural angular frequency.

Next, in step S5, the dynamic characteristic adjusting unit 74 determines whether or not there is a difference between the parameters estimated by the parameter estimation unit 73, that is, the operation skill evaluation values and preset index values.

When it is determined that there is the difference between the operation skill evaluation values and the index values (YES in step S5), in step S6, the dynamic characteristic adjusting unit 74 adjusts a dynamic characteristic of the work device 30 based on the difference between the operation skill evaluation values estimated by the parameter estimation unit 73 and the preset index values. That is, the dynamic characteristic adjusting unit 74 changes the dynamic characteristic of the work device 30 by changing the parameters of a controller of the work device 30 based on the difference between the operation skill evaluation values estimated by the parameter estimation unit 73 and the preset index values. The dynamic characteristic of the work device 30 is a speed or an acceleration, for example.

On the other hand, when it is determined that there is no difference between the operation skill evaluation values and the index values (NO in step S5), the processing is finished without adjusting the dynamic characteristic of the work device 30.

As described above, the dynamic characteristic of the work device 30 is adjusted by the dynamic characteristic adjusting unit 74 and hence, even an operator at a low skill level can operate the construction machine 100 in the same manner as an expert and can perform work efficiently. That is, the dynamic characteristic of the work device 30 is adjusted according to an operation skill of the operator and hence, the work can be performed in a stable manner, and the productivity can be enhanced. Specifically, it is possible to suppress an overshoot of a speed caused by an erroneous operation and can realize an efficient work speed. Accordingly, a work can be performed efficiently by a stable and smooth operation.

In a case where the control device 70 includes the dynamic characteristic adjusting unit 74, the dynamic characteristic adjusting unit 74 may be configured to change the preset index values provided for comparison with the operation skill evaluation values (parameters of the transfer function which is the equivalent system) according to an operation method or a work content. In this case, the index values can be adjusted according to the operation method or the work content and hence, the work device 30 can be efficiently operated in various operations or works.

As has been described above, according to the present embodiment, it is possible to provide the construction machine 100 which can clearly distinguish the difference in operation characteristics between an expert and a non-expert, simply and accurately evaluates operation skills of the operators, and efficiently controls the construction machine 100 based on the evaluation of the operation skill of the operator.

In the present embodiment, the control device 70 may be disposed in the cab mounted on the upper slewing body 20, for example. The control device 70 may be mounted on an external apparatus which is communicably connected to the construction machine 100 via a network. The external apparatus is a server or a personal computer, for example. In this case, the construction machine 100 transmits a motion state amount and a driving force to the external apparatus. The external apparatus receives the motion state amount and the driving force. The external apparatus transmits adjustment data for adjusting a dynamic characteristic of the work device 30 to the construction machine 100. The construction machine 100 receives the adjustment data transmitted from the external apparatus. The construction machine 100 controls the work device 30 based on the received adjustment data.

Further, the control device 70 includes a computer, and when the computer executes a program, respective functions of the motion state acquisition unit 71, the equivalent system forming unit 72, the parameter estimation unit 73, and the dynamic characteristic adjusting unit 74 are performed. A computer has a processor which operates in accordance with a program as a main hardware configuration. A kind of processor is not limited as long as the functions can be realized by executing the program. The processor may be formed of one or a plurality of electronic circuits which include a semiconductor integrated circuit (IC) or a large scale integration (LSI), for example. The plurality of electronic circuits may be integrated on one chip or may be mounted on a plurality of chips. The plurality of chips may be integrated in one device, or may be provided to a plurality of devices. The program is recorded in a non-volatile recording medium such as a ROM, an optical disc or a hard disk drive which is readable by the computer. The program may be stored in a recording medium in advance, or may be supplied to a recording medium via a wide area communication network including the Internet or the like.

Further, the construction machine 100 may further include a presentation unit which presents operation skill evaluation values for an operator estimated by the parameter estimation unit 73 to the operator. The presentation unit is a display unit which displays operation skill evaluation values, for example.

(Operation Skill Evaluation)

Hereinafter, the operation skill evaluation for an operator by the control device 70 of the present embodiment is described. As shown in FIG. 1, the construction machine 100 such as a hydraulic excavator operates in combinations of a plurality of attachments such as the boom 31, the arm 32, and the bucket 33. Accordingly, the combinations of operations are complicated and hence, it is difficult to evaluate the operation skill (skill) of an operator based on a relationship between the operations of the respective attachments and operation amounts of the operator.

In view of the above, in the description made hereinafter, first, a combined center of gravity of the work device 30 is calculated. Next, a motion of the combined center of gravity is expressed by a polar coordinate system, and a transfer function which uses an angular velocity (a motion state amount) of the combined center of gravity as an output and uses a rotational torque (a driving force) of the work device 30 as an input is formed as an equivalent system which equivalently expresses the motion of the center of gravity of the work device 30. The details of the equivalent system are described later in "Construction of Equivalent System using Combined Center of Gravity". Subsequently, the equivalent system is applied to a boom raising and decelerating operation of the hydraulic excavator, and parameters of the transfer function are estimated using a genetic algorithm (GA). The details of the parameters are described later in "Parameter Estimation". Next, the difference in operation characteristics between an expert and a non-expert is clearly distinguished by comparing respective estimated parameters of the expert and the non-expert. The details of clarifying the difference in operation characteristics are described later in "Test Results of Operation Skill Evaluation". An evaluation index (an index value) which corresponds to an efficient operation is formed based on the estimated parameters. The details of the formation of the index value are described later in "Index Value of Skill Evaluation". Further, a dynamic characteristic (acceleration, speed and the like) of the work device 30 is adjusted such that the construction machine 100 can be efficiently performed based on the difference between an operation skill evaluation value for an operator during work and an index value. The details of adjusting a dynamic characteristic of the work device 30 are described later in "Control using Index Values".

(Construction of Equivalent System Using Combined Center of Gravity)

Figure 5:
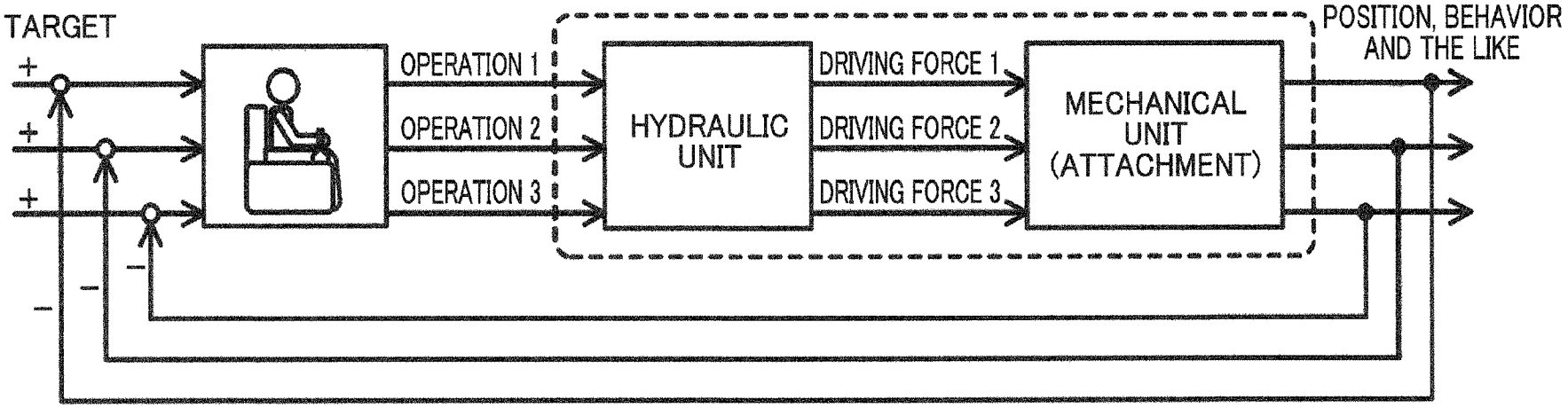
FIG. 5 is a view showing a configuration of a feedback system of the work device according to the present embodiment.

FIG. 5 is a view showing a configuration of a feedback system of the work device according to the present embodiment.

Usually, the operator adjusts an operation amount while visually observing the motion of the attachment to realize the desired motion. Such motion is represented by a closed-loop system which includes a human as shown in FIG. 5. In a closed loop system, in general, a hydraulic unit and a mechanical unit respectively have a non-linear motion. Although it is difficult to express the motion of the hydraulic unit by an equation, the motion of the hydraulic unit can be expressed by a motion equation of a rotating system expressed by a following equation (1). Terms on inertia of respective attachment elements cause interference between the motion equations of the respective attachment elements. Accordingly, in an equation (1), the motion is limited to the motion of two links (boom and arm) by omitting the motion of the bucket for simplifying the motion equation.

[Formula 1]

$$\begin{bmatrix} M_{11} & M_{12} \\ M_{21} & M_{22} \end{bmatrix} \begin{bmatrix} \frac{d^2\theta_1}{dt^2} \\ \frac{d^2\theta_2}{dt^2} \end{bmatrix} + \begin{bmatrix} h_1 \\ h_2 \end{bmatrix} + \begin{bmatrix} \phi_1 \\ \phi_2 \end{bmatrix} = \begin{bmatrix} \tau_1 \\ \tau_2 \end{bmatrix} \tag{1}$$

In the equation (1), $M_{11}$, $M_{12}$, $M_{21}$ and $M_{22}$ indicate the moments of inertia of the attachment elements, $d^2\theta_1/dt^2$ and $d^2\theta_2/dt^2$ indicate angular accelerations, $h_1$ and $h_2$ indicate centrifugal forces, and $\phi_1$ and $\phi_2$ indicate gravities, $\tau_1$ and $\tau_2$ indicate driving torques of the attachment elements, a subscript "1" indicates terms acting on the boom, and a subscript "2" indicates terms acting on the arm. The moments of inertia $M_{12}$ and $M_{21}$ are interference terms which influence the motion of the boom and the motion of the arm when the boom and the arm move simultaneously.

Meanwhile, a short-term storage capacity of a human is said to be about 4 items, and it is considered that a human does not perform a motion or an operation as a higher-order system with a large number of parameters. Accordingly, the inventors assume that the operator handles and operates a relatively low-dimensional system in order to obtain the desired motion of the mechanical system represented by the equation (1).

Figure 6:
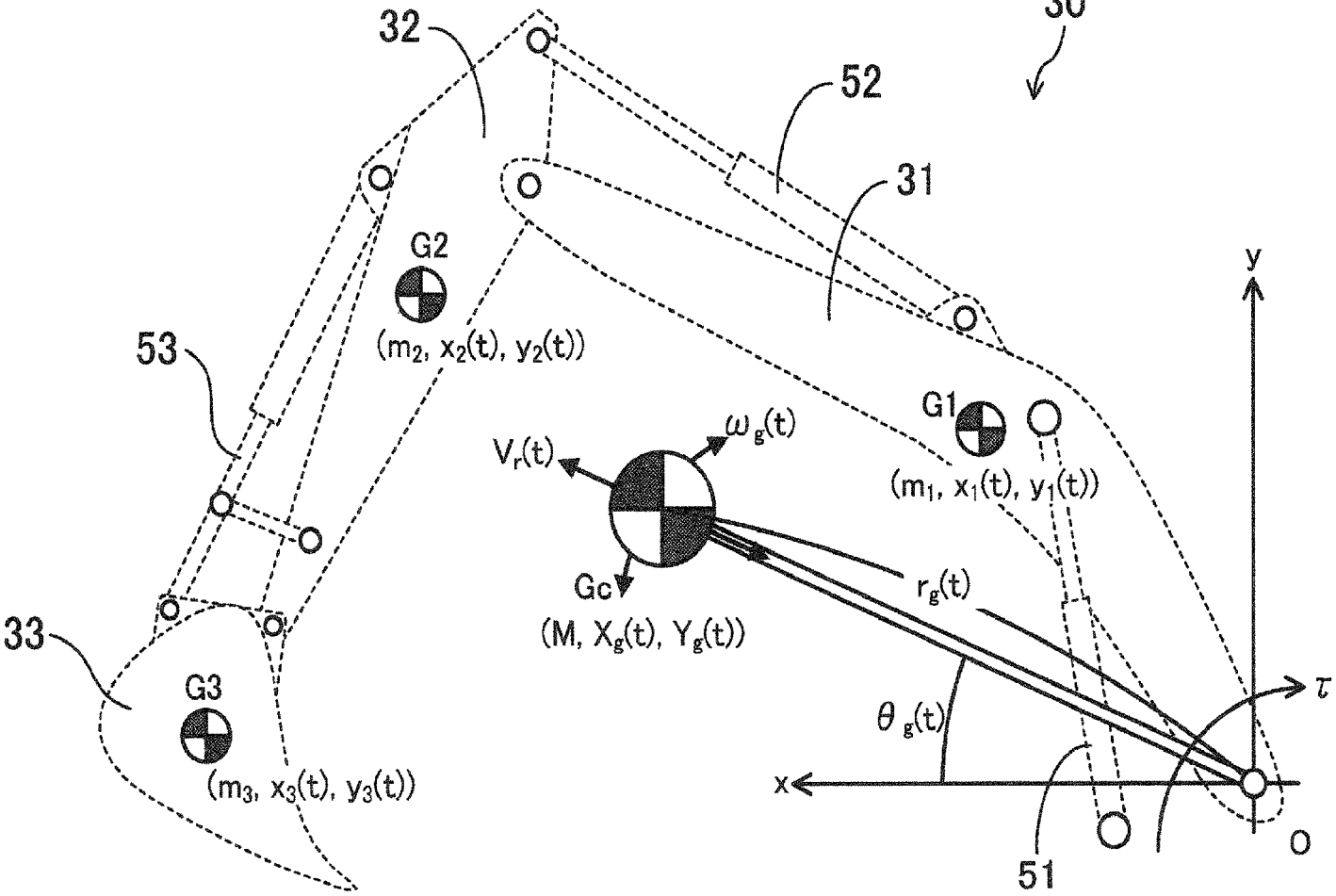
FIG. 6 is a view for describing a combined center of gravity of the work device according to the present embodiment.

FIG. 6 is a view for describing the combined center of gravity of the work device according to the present embodiment. In order to express as a low-dimensional system, the coordinates ($X_g(t)$, $Y_g(t)$) of the entire center of gravity (combined center of gravity) Ge of the attachments shown in FIG. 6 are calculated by a following equation (2). In FIG. 6, M indicates a mass of the entire attachments, and G1, G2, and G3 indicate the centers of gravity of the boom 31, the arm 32, and the bucket 33 respectively. In FIG. 6, the constitutional elements identical to the corresponding constitutional elements of the construction machine 100 shown in FIG. 1 are given the same symbols.

[Formula 2]

$$(X_g(t), Y_g(t)) = \left( \frac{\sum_{i=1}^{3} m_i x_i(t)}{m_1 + m_2 + m_3}, \frac{\sum_{i=1}^{3} m_i y_i(t)}{m_1 + m_2 + m_3} \right) \quad (2)$$

As shown in FIG. 6, in the equation (2), i represents each component of the attachment, i=1 indicates the boom 31, i=2 indicates the arm 32, and i=3 indicates the bucket 33. Further, mi indicates the mass of each attachment element, and $x_i(t)$ and $y_i(t)$ indicate the position of the center of gravity of each attachment element at a point of time t in an xy coordinate system using a proximal end of the boom 31 shown in FIG. 6 as an origin O. The bucket mass $m_3$ includes the mass of soil and sands in the bucket. The position of the center of gravity $x_i(t)$ and $y_i(t)$ of each attachment element can be directly measured or can be calculated from angular information on the attachment which can be measured. Subsequently, the coordinates $(X_g(t), Y_g(t))$ of the combined center of gravity $G_c$ are converted into polar coordinates using following equations (3) to (6).

[Formula 3]

$$\theta_g(t) = \tan^{-1} \frac{Y_g(t)}{X_g(t)} \quad (3)$$

[Formula 4]

$$r_g(t) = \sqrt{X_g^2(t) + Y_g^2(t)} \quad (4)$$

[Formula 5]

$$\omega_g(t) = \frac{d\theta_g(t)}{dt} \quad (5)$$

[Formula 6]

$$v_r(t) = \frac{dr_g(t)}{dt} \quad (6)$$

As shown in FIG. 6, in the equations (3) to (6), $\theta_g(t)$ and $r_g(t)$ indicate the position of the center of gravity in polar coordinates, and $\omega_g(t)$ indicates an angular velocity around the origin O, and $V_r(t)$ indicates a radial velocity. In this description, by setting only the boom raising operation as a targeted motion, the interference terms to the boom motion brought about by the arm motion or the bucket motion is omitted. Next, as described above, assuming that an operator grasps the operation with a low-dimensional linear system, the motion of the combined center of gravity is expressed by a following equation (7).

[Formula 7]

$$\tau(t - L) = J \frac{d^2\omega(t)}{dt^2} + I \frac{d\omega(t)}{dt} + D_c\omega(t) \quad (7)$$

In the equation (7), J indicates a jerk with respect to a motion of the center of gravity, I indicates a moment of inertia, De indicates a damping coefficient, L indicates a dead time, and τ indicates a driving torque for driving the boom. Hereinafter, the description is made with respect to a method for expressing the difference in skill between operators by estimating the parameters J, I, and $D_c$ in the system expressed by the equation (7). A hydraulic system is expressed by the dynamics of a mechanical system. In the description made hereinafter, it is assumed that the hydraulic system is not influenced by an operator's skill, and the hydraulic system is not taken into account. Next, an input/output relationship of the equation (7) is expressed by a transfer function G(s) and hence, a following equation (8) is obtained.

[Formula 8]

$$G(s) = \frac{1}{Js^2 + Is + D_c} e^{-Ls} \quad (8)$$

(Parameter Estimation)

Hereinafter, the description is made with respect to a method of expressing the difference in skill between operators by estimating the parameters expressed in the equation (8). The parameters of the equivalent system which are to be evaluated are substantially determined based on the specification or motions of a construction machine such as a hydraulic excavator. Accordingly, for example, the parameters in the equation (8) are estimated in accordance with the following steps using a genetic algorithm (GA) where a search range can be set as an estimation method.

[First Step] Generation of Initial Individuals

N (for example, 200) pieces of individuals f each having a jerk J, a moment of inertia I, a damping coefficient $D_c$, and a dead time L as genes are generated at random.

[Second Step] Initial Evaluation

The genes of the individual generated in the first step are put into the equation (8), and acquired data (motion state of the combined center of gravity) is discretized at a sampling time Ts so that an approximation of a transfer function of a second-order lag system shown in a following equation (9) can be obtained. A numerical value analysis software is used for such calculation.

[Formula 9]

$$G(z^{-1}) = \frac{z^{-(d+1)} b_0}{1 + a_1 z^{-1} + a_2 z^{-1}} \quad (9)$$

In the equation (9), $a_1$, $a_2$, and $b_0$ indicate constants, and d indicates the number of steps in the dead time. From the equation (9), an estimated system output $y_s(k)$ is calculated by a following equation (10).

[Formula 10]

$$y_s(k) = -a_1 y_s(k-1) - a_2 y_s(k-2) + b_0 u_0(k-d-1) \quad (10)$$

In the equation (10), $u_0$ indicates a system input. In the parameter estimation, for example, an evaluation function $J_E$ expressed by a following equation (11) is used.

[Formula 11]

$$J_E = \frac{1}{1 + \frac{1}{n} \sum_{k=1}^{n} (y(k) - y_s(k))^2} \quad (11)$$

In the equation (11), n indicates the total number of steps, and y(k) indicates a combined-center-of-gravity speed obtained by measurement using an actual machine. The compatibility of the individual becomes higher as an evaluation function $J_E$ expressed by the equation (11) is closer to 1.

[Third Step] Elite Selection

The individuals having highest compatibility are preserved as elites and are carried over to a population of the next generation.

[Fourth Step] Tournament Selection

The individual $f_m$ and the other two individuals $f_{rdm1}$ and $f_{rdm2}$ are extracted from the population at random, and compatibilities of the extracted individuals are compared with each other. The individual having the best compatibility is selected and the selected individual is updated as an individual $f_m$.

[Fifth Step] Crossing

Two individuals $f_m$ and $f_n$ are extracted from the population at random. The genes of two extracted individuals are replaced with each other in accordance with a following formula (12), and two new individuals $f_{mnew}$ and $f_{nmew}$ having higher compatibility are generated and updated.

[Formula 12]

$$\left.\begin{aligned} f_{mnew} &= J_{E_{max}}(f_m, f_n) + \frac{|f_m - f_n|}{4} \\ f_{nmew} &= J_{E_{max}}(f_m, f_n) - \frac{|f_m - f_n|}{4} \end{aligned}\right\} \quad (12)$$

[Sixth Step] Mutation

Each individual is replaced with an individual having a new gene with a fixed probability. The fixed probability is 30%, for example.

[Seventh Step] Completion of Calculation

The above steps 1 to 6 are repeated up to the number of generations G (for example, 200th generation). At a point of time that the calculation in the final generation is completed, the gene of the individual $f_{best}$ having the highest compatibility is extracted from the population as an estimation (identification) parameter.

(Test Result of Operation Skill Evaluation)

Figure 7:
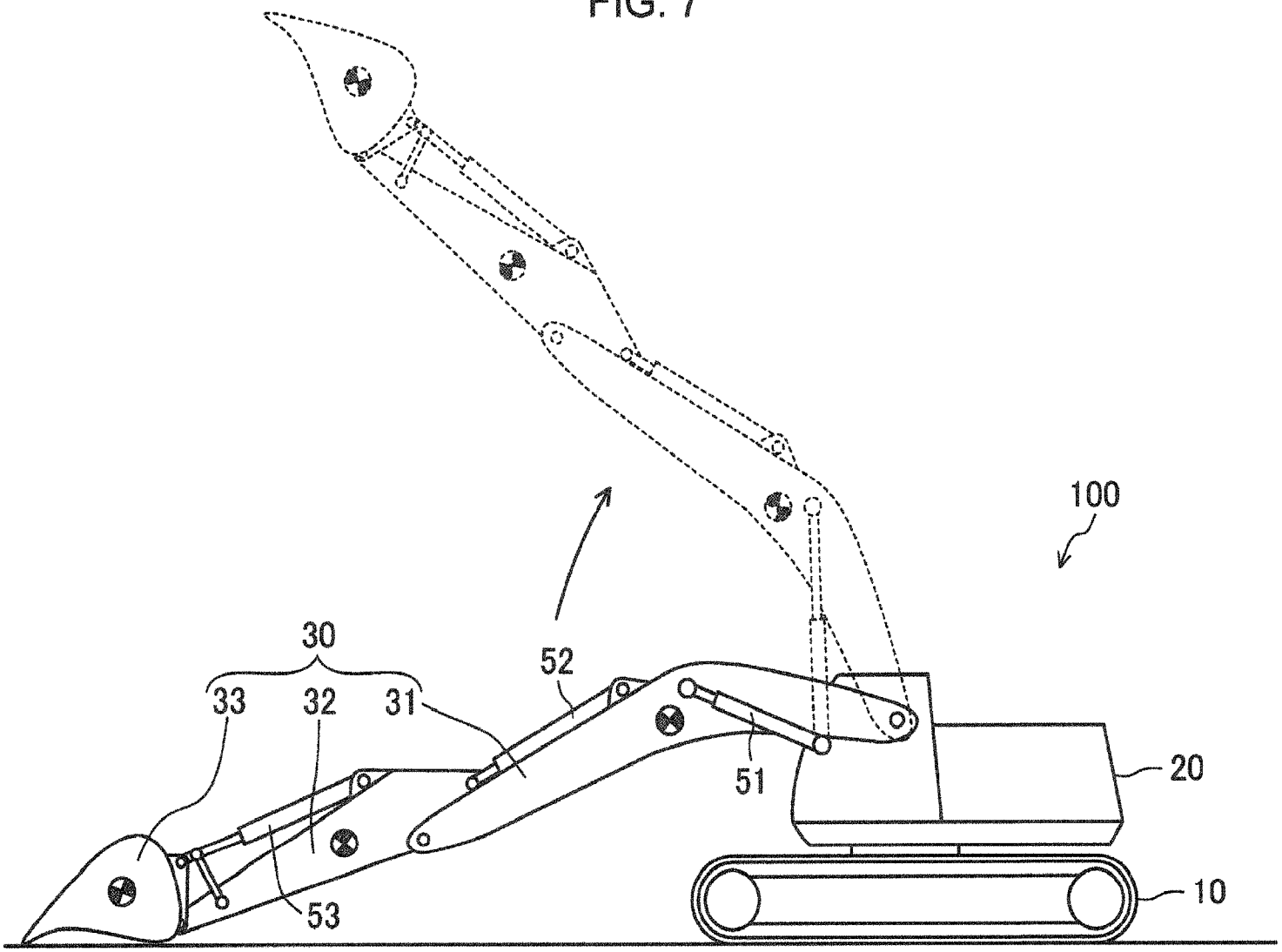
FIG. 7 is a view for describing a condition of an operation skill evaluation test according to the present embodiment.

FIG. 7 is a view for describing a condition of an operation skill evaluation test according to the present embodiment.

The following conditions are used in the operation skill evaluation test.

- Operation contents: Steps from a boom raising single instantaneous maximum operation to a stop operation are performed 5 times.
- Initial posture: Maximum reach (see solid line position in FIG. 7).
- Stop posture: Boom foot vertical (see broken line position in FIG. 7).

In FIG. 7, constitutional elements identical to the corresponding constitutional elements of the construction machine 100 shown in FIG. 1 are given the same symbols.

In this test condition, an actuator speed and inertia become large and hence, it is difficult to stop the motion of the construction machine. Accordingly, the difference in skill is likely to occur between operators. Further, as one of the test conditions, operators who ride on the construction machine are requested to "stop the construction machine without generating a shock". It is because the difference in skill is generated more apparently in deceleration. The evaluation is performed in a deceleration stop section of the series of operations. An acceleration section is already set in an instantaneous maximum operation, and no difference in skill occurs between operators and hence, the acceleration section was excluded from the evaluation. A hydraulic excavator SK200-9 (standard specification) manufactured by Kobelco Construction machine Co., Ltd. is used for the data acquisition test.

Figure 8:
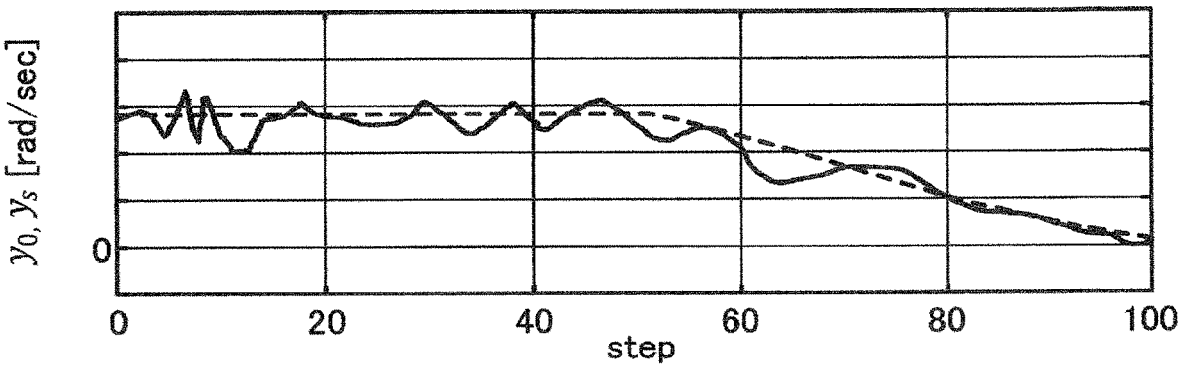
FIG. 8 is a view showing a parameter estimation target data (output data) in the operation skill evaluation test according to the present embodiment.
Figure 9:
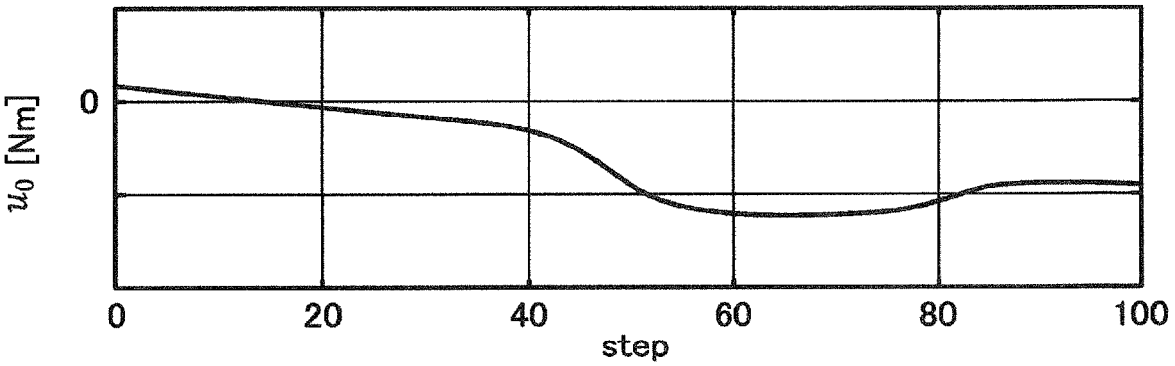
FIG. 9 is a view showing a parameter estimation target data (input data) in the operation skill evaluation test according to the present embodiment.

FIG. 8 is a view showing parameter estimation target data (output data) in the operation skill evaluation test according to the present embodiment. FIG. 9 is a view showing parameter estimation target data (input data) in the operation skill evaluation test according to the present embodiment. The output data is a combined-center-of-gravity speed, and the input data is a driving torque. In FIG. 8, a solid line indicates actually measured data and a broken line indicates estimated data.

As shown in FIG. 8 and FIG. 9, parameters were estimated with respect to the target data measured from a steady speed state to a zero speed state.

Figure 10:
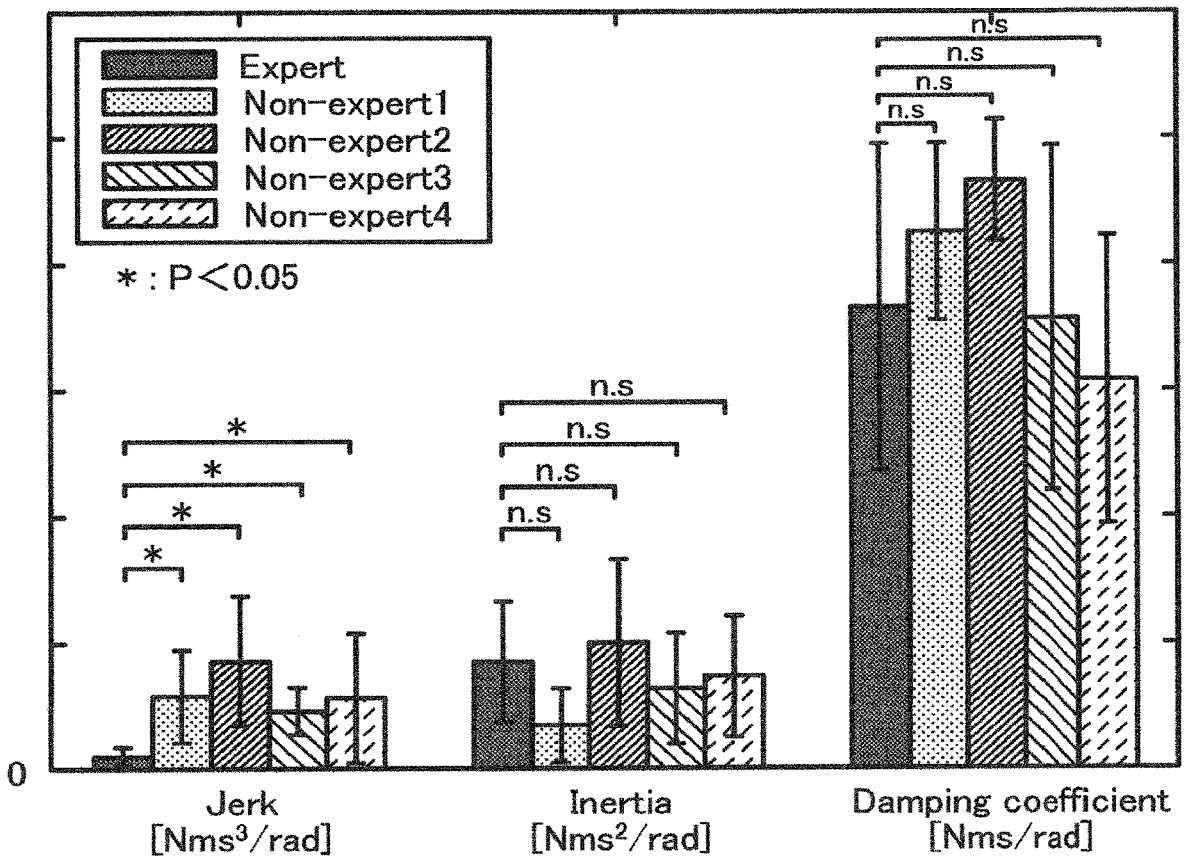
FIG. 10 is a view showing a parameter estimation result in the operation skill evaluation test according to the present embodiment.

FIG. 10 is a view showing a parameter estimation result in the operation skill evaluation test according to the present embodiment.

The parameter estimation result shown in FIG. 10 indicates a result of an operation skill evaluation test in which one expert and four non-experts are subjects. In data shown in FIG. 10, an average value and a standard deviation of each subject is indicated. From the result shown in FIG. 10, with respect to the moment of inertia I and the damping coefficient De, no significant difference is observed between the expert and the non-experts in a t-test with a significance level of 5%. On the other hand, with respect to the jerk J, the jerk J of the expert is one fourth or less of the jerk J of the non-experts, that is, the jerk J of the expert is apparently smaller than the jerk J of the non-experts. Accordingly, a significant difference is between the expert and the non-experts. This indicates that the deceleration operation of the expert is a motion with a small change in deceleration. This also indicates a characteristic of an operation which realizes a smooth motion. From these results, it is apparent that even when the motions of the plurality of attachments are treated as the motion of the combined center of gravity, a characteristic of an operation skill of an operator and a physical characteristic which is commensurate with the phenomenon appear as system parameters.

Subsequently, in the system for handling the combined center of gravity described above, the evaluation is made from a viewpoint of control engineering. In the system, a transfer function G(s) is of a second-order lag system. Accordingly, the transfer function G(s) is expressed by a standard form of a following equation (13).

[Formula 13]

$$G(s) = \frac{K\omega_n^2}{s^2 + 2\zeta\omega_n s + \omega_n^2} e^{-Ls} \quad (13)$$

Here, by comparing the coefficients in the equation (8) with the coefficients in the equation (13), a system attenuation coefficient ζ and a natural angular frequency ω~ are calculated as expressed by an equation (14) and an equation (15) described below respectively.

[Formula 14]

$$\zeta = \frac{I}{2\sqrt{JD_c}} \tag{14}$$

[Formula 15]

$$\omega_n = \sqrt{\frac{D_c}{J}} \tag{15}$$

Figure 11:
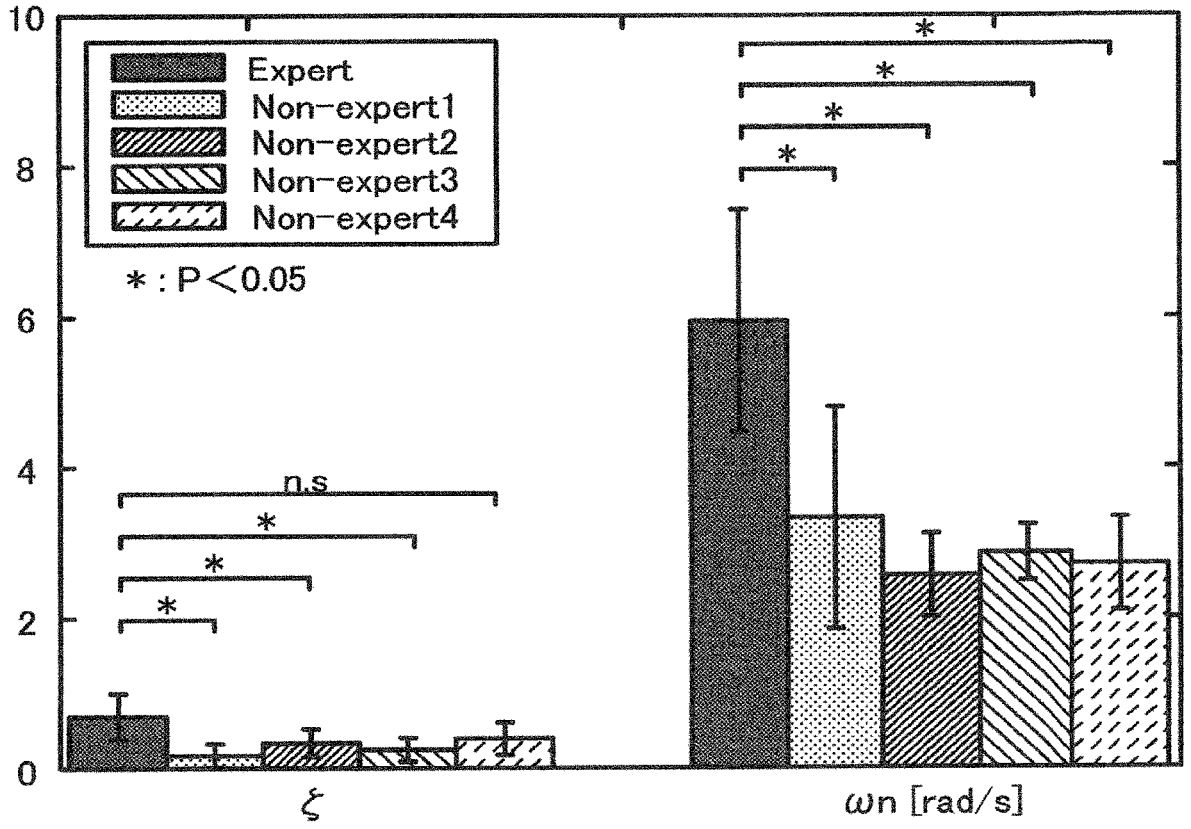
FIG. 11 is a view showing a system attenuation coefficient and a natural angular frequency calculated based on the parameter estimation result shown in FIG. 10.

FIG. 11 is a view showing the system attenuation coefficient and the natural angular frequency calculated based on the parameter estimation result shown in FIG. 10.

FIG. 11 indicates the result obtained by calculating the system attenuation coefficient $\zeta$ and the natural angular frequency $\omega_n$ by putting the parameter estimation result (the moment of inertia I, the damping coefficient $D_c$ and the jerk J) indicated in FIG. 10 into the equation (14) and the equation (15). With respect to a system gain K, the test conditions are set equal and hence, no difference occurs between the subjects. Accordingly, the system gain K is not evaluated. The data shown in FIG. 11 are average values and standard deviations for each subject.

As shown in FIG. 11, to compare the expert and the non-expert, a clear difference is found in both the system attenuation coefficient $\zeta$ and the natural angular frequency $\omega_n$, and a significant difference is found in a t-test of a significance level of 5%. Specifically, the system attenuation coefficient $\zeta$ of the expert is two times or more as large as the system attenuation coefficient $\zeta$ of the non-expert. This indicates that the attenuation characteristic of the expert at the time of following the target is high. Further, the system attenuation coefficient $\zeta$ of the expert is close to the critical attenuation ($\zeta$=1). Accordingly, it is understood that the system of the expert is a system where the system attenuation coefficient $\zeta$ follows a target value more stably than the system of the non-expert. However, in the result of this experiment, with respect to only the non-expert 4, no significant difference is observed in the system attenuation coefficient $\zeta$ at the significance level of 5%. Furthermore, the natural angular frequency $\omega_n$ of the expert is approximately two times as large as the natural angular frequency $\omega_n$ of the non-expert. This indicates that the expert can realize a high-speed-responsive operation.

Subsequently, the difference in skill between operators is evaluated based on the control engineering evaluation result described above.

Figure 12:
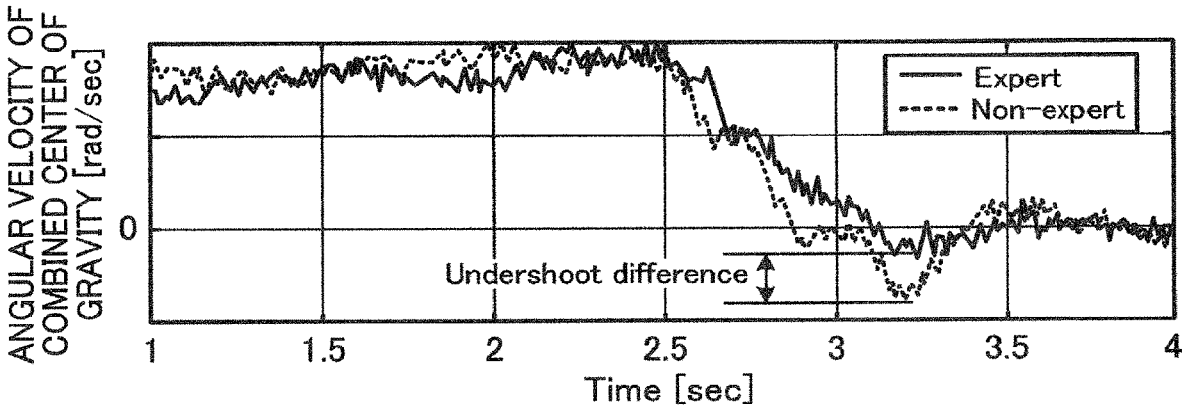
FIG. 12 is a view showing a change with time in a combined-center-of-gravity speed in the operation skill evaluation test according to the present embodiment.
Figure 13:
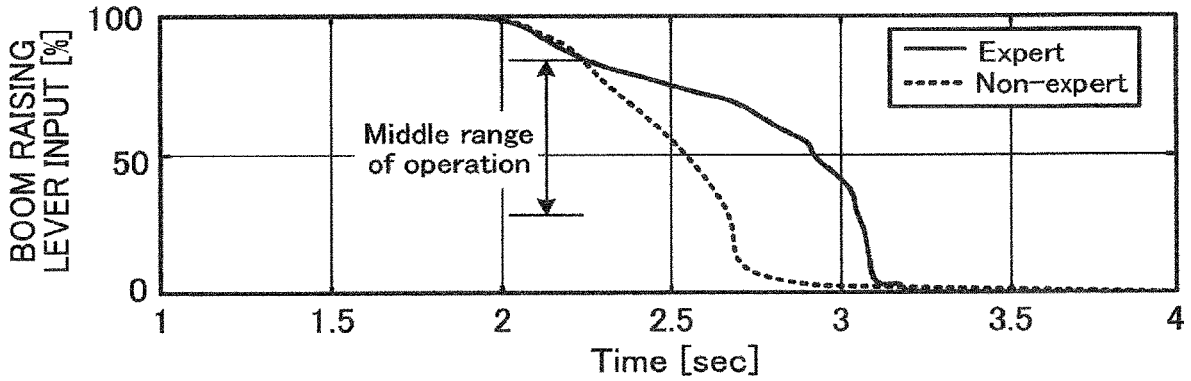
FIG. 13 is a view showing a change with time of a lever input in the operation skill evaluation test according to the present embodiment.

FIG. 12 is a view showing a change with time in a combined-center-of-gravity speed in the operation skill evaluation test according to the present embodiment. FIG. 13 is a view showing a change with time of a lever input in the operation skill evaluation test according to the present embodiment.

FIG. 12 and FIG. 13 show the result of extracting a combined-center-of-gravity speed and a lever input amounting one cycle when the expert and the non-expert perform a boom raising and decelerating operation. To compare the expert and the non-expert with respect to a lever input, from the results shown in FIG. 12 and FIG. 13, it is understood that the expert suppresses a speed undershoot by performing a slow operation before stopping in a middle range of the operation and hence, the attenuation characteristic of the operation of the expert is higher than the attenuation characteristic of the operation of the non-expert. In addition, the expert returns the lever in conformity with a speed and performs an operation when the lever input becomes zero simultaneously with the stopping of the operation. This indicates that the operation of the expert is an operation with a high frequency response, that is, the operation of the expert exhibits a high speed responsiveness.

On the other hand, the non-expert performs a sudden operation in the middle range of the operation and hence, an undershoot occurs due to a sudden deceleration, and the convergence is deteriorated. Further, the lever input is already set to zero before stopping the operation. This indicates that the operation performed by the non-expert is an operation with a low frequency response, that is, a speed responsiveness is low.

The above-mentioned tendency can be understood from a magnitude of the system attenuation coefficient $\zeta$ and a magnitude of the natural angular frequency $\omega_n$. Accordingly, by expressing an input/output relationship of the equivalent system using a combined center of gravity by the equation (13), the system attenuation coefficient $\zeta$ expresses the attenuation characteristic, and the natural angular frequency $\omega_n$ expresses the speed responsiveness (working speed). Accordingly, it is possible to evaluate the skill of the operator based on the magnitude of the parameters, that is, the system attenuation coefficient $\zeta$ and the natural angular frequency $\omega_n$. To explain by giving an example, in a case of considering a rotational motion of a system where an object having a mass M is attached to a distal end of a beam having no weight, an expert operates the system by changing a characteristic of the beam such that an object does not vibrate and the motion exhibits a favorable speed responsiveness. On the other hand, a non-expert operates the system by beam in a state where the object easily vibrates.

(Index Value of Skill Evaluation)

Hereinafter, index values set for the operation skill evaluation values, that is, the system attenuation coefficient $\zeta$ and the natural angular frequency an are described.

In a step response of a second-order lag system, it is understood that, assuming that an output follows a target value when the output is within ±5% of the target value, a system attenuation coefficient $\zeta$ with which an operation is stopped at a fastest speed in monotonous deceleration where resonance does not generally occur is approximately 0.7 ($=1/\sqrt{2}$). Accordingly, this value can be set to an index value $\zeta_r$ of the system attenuation coefficient $\zeta$.

Next, although a speed responsiveness becomes higher as a natural angular frequency $\omega_n$ is larger, and the operation stops speedily, there is a limit with respect to a speed at which the operation can be stopped depending on the specification, the condition or the like of an excavator and the like, and an upper limit of a natural angular frequency on is determined based on such a limit speed. In view of the above, in order to stop the operation by taking into account a characteristic of the machine earliest and to determine an upper limit value of a natural angular frequency $\omega_n$, a sudden stop is performed by a sudden operation under the above-mentioned test condition (see FIG. 7), and system parameters at the time of sudden stop are estimated, and control engineering parameters formed of a system attenuation coefficient $\zeta$ and a natural angular frequency $\omega_n$ are calculated.

Figure 14:
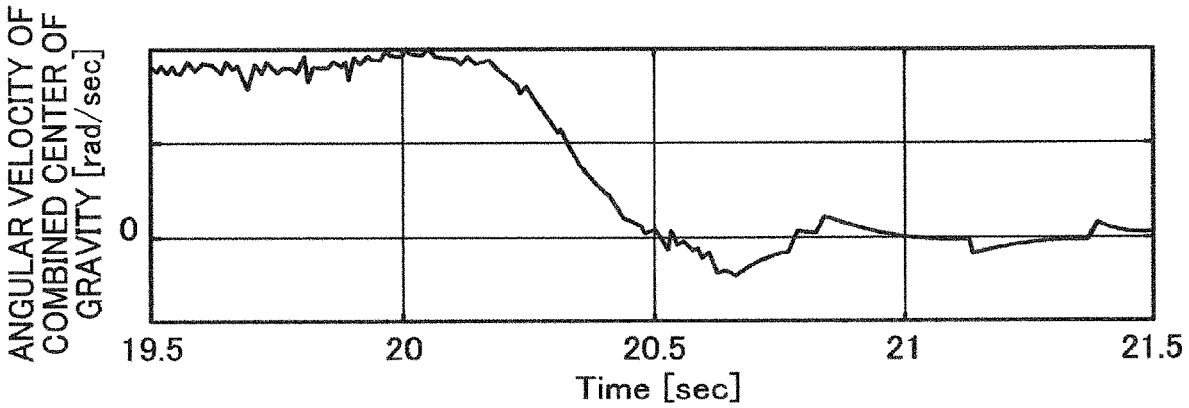
FIG. 14 is a view showing a change with time in a combined-center-of-gravity speed in a test for setting an index value according to the present embodiment.
Figure 15:
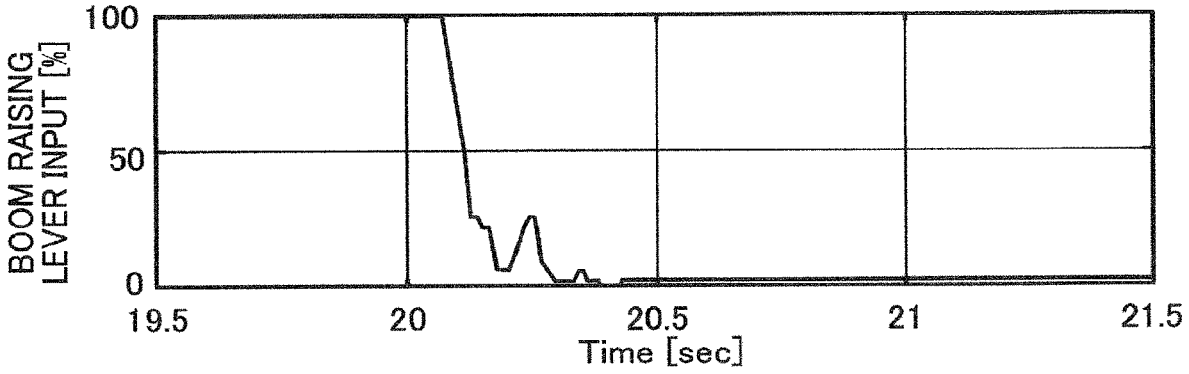
FIG. 15 is a view showing a change with time in a lever input in the test for setting the index value according to the present embodiment.

FIG. 14 is a view showing a change with time in a combined-center-of-gravity speed in a test for setting index values according to the present embodiment. FIG. 15 is a view showing a change with time in a lever input in the test for setting the index values according to the present embodiment. FIG. 16 is a view showing a parameter table calculated from data shown in FIG. 14 and FIG. 15.

As shown in FIG. 16, when the operation lever is rapidly returned to a neutral position and the machine is suddenly stopped due to performance of the machine, 8.5 is obtained as a value of a natural angular frequency $\omega_n$. Due to the characteristics of the machine, the deceleration stop with further higher speed responsiveness cannot be performed. Accordingly, this value can be set as an index value $\omega_{nr}$ of a natural angular frequency. In this test, a speed undershoot occurs due to sudden deceleration and the convergence is deteriorated and hence, a system attenuation coefficient $\zeta$ shown in FIG. 16 is lowered.

FIG. 17 is a view showing a comparison between set index values according to the present embodiment and the parameter estimation results of respective subjects shown in FIG. 11.

FIG. 17 shows a result of comparison between the index value $\zeta_r$ of the system attenuation coefficient and the index value con, of the natural angular frequency set as described above and the subject data (operation skill evaluation values) shown in FIG. 11. As shown in FIG. 17, a system attenuation coefficient $\zeta$ of an expert is a value close to an index value $\zeta_r$ and it is understood that an attenuation characteristic is theoretically optimal. On the other hand, although a natural angular frequency $\omega_n$ of an expert is closer to an index value $\omega_{nr}$ than a natural angular frequency on of a non-expert, there is still a difference between the natural angular frequency $\omega_n$ of the expert and the index value $\omega_{nr}$. Accordingly, it is considered that the speed responsiveness of the expert can be further enhanced.

On the other hand, as shown in FIG. 12 and FIG. 13, although the non-expert performs a gentle operation at an initial stage of deceleration, the non-expert performs a sudden operation from the middle range of the operation, thus causing deterioration of convergence due to an undershoot. As a result, a system attenuation coefficient $\zeta$ of the non-expert is low and is close to a system attenuation coefficient $\zeta$ shown in FIG. 16. This indicates that the attenuation brought about by the operation of the non-expert is close to the performance of the machine itself, and means that the proper deceleration cannot be performed. In this respect, as described above, it is safe to say that the expert can operate the construction machine 100 as desired by performing an operation so as to obtain better characteristics.

(Control Using Index Values)

Next, the inventors have improved the boom raising/decelerating/stopping operation of the non-expert based on two index values set as described above. Specifically, the inventors made an improvement of the construction machine 100 by incorporating a mechanical mechanism capable of changing a lever operation amount of the hydraulic excavator and by incorporating the system which can stop at a predetermined position with respect to a vehicle loaded controller such that a stop operation is performed so as to make the system attenuation coefficient $\zeta$ and the natural angular frequency $\omega_n$ as close as possible to the index values $\zeta_r$ and $\omega_{nr}$.

Figure 18:
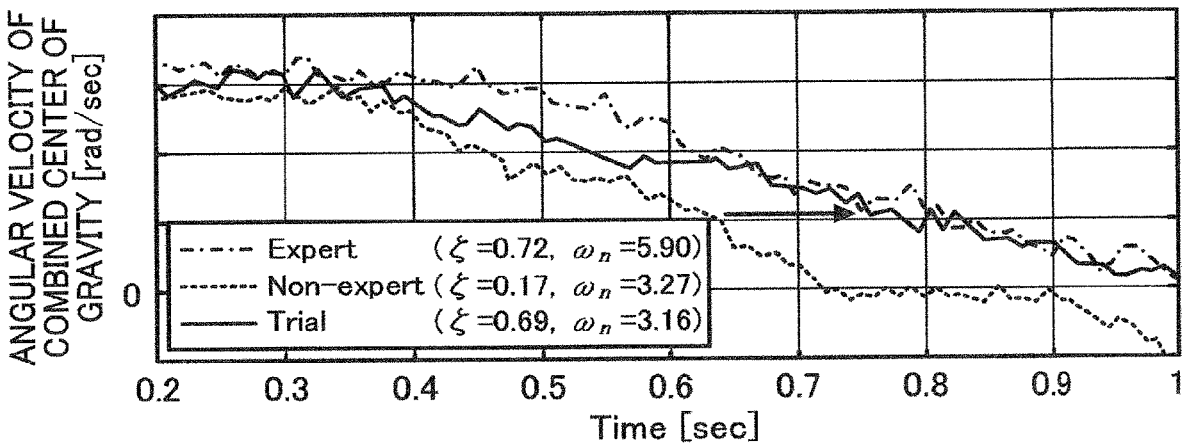
FIG. 18 is a view showing a change with time in an angular velocity of a combined center of gravity in a control using the index value according to the present embodiment.
Figure 19:
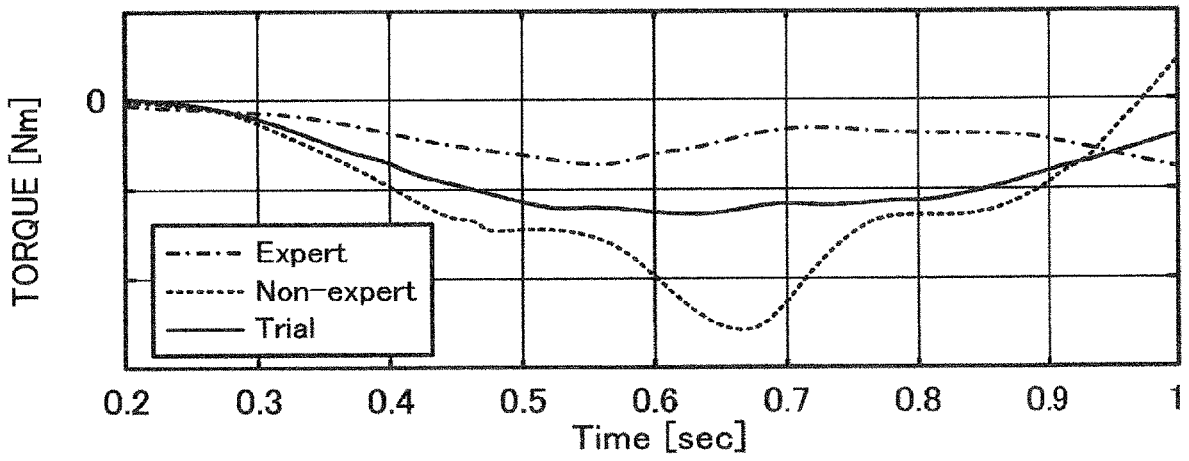
FIG. 19 is a view showing a change with time in an input torque in a control using the index value according to the present embodiment.

FIG. 18 is a view showing a change with time in angular velocity of the combined center of gravity in a control using index values according to the present embodiment. FIG. 19 is a view showing a change with time in an input torque in the control using the index values according to the present embodiment.

FIG. 18 and FIG. 19 show a change with time in angular velocity of the combined center of gravity and a change with time in inputting torque in the boom raising/decelerating/stopping operation by the expert, the non-expert before the modification of the construction machine, and the non-expert (trial) after the modification of the construction machine. As shown in FIGS. 18 and 19, the system attenuation coefficient $\zeta$ of the trial after the modification of the construction machine becomes substantially equal to the index value $\zeta_r$. On the other hand, since a deceleration characteristic of a natural angular frequency $\omega_n$ is linear due to mechanical constraints, the deceleration becomes slower when stopping was emphasized, and no improvement is observed. However, the stopping behavior of the combined center of gravity approximates the data of the expert so that it is confirmed that the desired effect can be obtained.

In this manner, it is found that, with the use of the index value $\zeta_r$ of the system attenuation coefficient and the index value $\omega_{nr}$ of the natural angular frequency, it is possible to perform not only the operation skill evaluation for the deceleration stop but also the improvement of the machine toward an ideal stop behavior.

The description of the embodiments described above is merely provided for an exemplifying purpose, and is not intended to limit the present invention, its application or its use. Various modifications are conceivable within the scope of the invention.

For example, in the present embodiment, the combined center of gravity of the plurality of attachments of the hydraulic excavator is calculated, and the operation of the hydraulic excavator is expressed as a virtual low-order linear system by input/output of the calculated combined center of gravity, and a relationship between the parameters of the system and the operation skill is clarified and the evaluation index values are set. In this embodiment, the hydraulic excavator provided with the bucket as the attachment at the distal end of the work device is exemplified. However, the present invention is also applicable to a hydraulic excavator provided with an attachment other than the bucket.

Further, in the present embodiment, the actual machine, the boom raising instantaneous maximum operation is performed, and after the operation reaches a steady speed, the deceleration and stopping operation at the target destination is performed. A hydraulic excavator is a system which has non-linearity due to the characteristics of the equipment. However, by treating the combined center of gravity, the system is regarded as a system with virtual linearity by expressing the motion of the work body as the motion of a model where an object of a mass M is attached to the distal end of the beam. As a result, the operation characteristics appear in the mechanical characteristics of the beam and hence, the skill evaluation in the deceleration stop section can be performed by estimating the parameters of the system. However, it is needless to say that the target operation of the skill evaluation is not limited to the operations from the boom raising single instantaneous maximum operation to the stop operation, and substantially the same skill evaluation can be also performed in the combined operation of moving other attachment (arm, bucket or the like).

In the present embodiment, the equivalent system is expressed by the second-order lag system, and a genetic algorithm is used in the parameter estimation method. However, the system model and the parameter estimation method are not particularly limited to the above-mentioned method.

In the present embodiment, by using the system attenuation coefficient $\zeta$ and the natural angular frequency $\omega_n$ which are parameters of the transfer function of the equivalent system as the operation skill evaluation values respectively expressing the attenuation characteristic and speed responsiveness, it is made apparent that the operation skill evaluation values have a quantitative relationship with the skill of the deceleration stop operation which contributes to work productivity. Further, the index value is set for each of the operation skill evaluation values, and a dynamic characteristic of the work device 30 is adjusted based on the difference between the operation skill evaluation values and the index values so that the non-expert can smoothly perform the smooth deceleration and the stop operation close to the deceleration and the stop operation of the expert. However, the scope of application of the present embodiment can be extended to operations other than the boom raising single operation. It is also possible to realize a control system which realizes efficient operations in the entire work by setting index values according to the operation method or a work content and by performing gain tuning of the controller according to the index values, for example.

Summary of Embodiments

The technical features of the present embodiment are summarized as follows.

A construction machine according to one aspect of the present invention includes: a lower travelling body; an upper slewing body attached to the lower travelling body with a structure which allows the upper slewing body to slew with respect to the lower travelling body, a work device which is attached to the upper slewing body with a structure which allows the work device to swing in a vertical direction with respect to the upper slewing body and includes a plurality of members; an acquisition unit which acquires a motion state amount of the combined center of gravity of the plurality of members; a forming unit which forms a transfer function which uses a driving force for moving the work device as an input and the motion state amount acquired by the acquisition unit as an output as an equivalent system which equivalently expresses an operation of the work device; and an estimation unit which estimates a system attenuation coefficient and a natural angular frequency of the transfer function formed by the forming unit as an operation skill evaluation value of an operator.

According to this configuration, the transfer function which uses a driving force for moving the work device including the plurality of members as an input and uses the motion state amount of the combined center of gravity of the plurality of members as an output is treated as the equivalent system which equivalently expresses the motion of the work device. Accordingly, the number of parameters expressing characteristics of the operation of operators can be reduced and hence, the operation skill of the operator can be easily evaluated. The characteristic amount of the operation of the operator can be obtained from system attenuation coefficient and the natural angular frequency of the transfer function and hence, the operation skill of the operator can be evaluated accurately. The attenuation characteristic which suppresses an overshoot speed can be quantitatively evaluated based on a system attenuation coefficient, and a speed responsiveness of the work can be quantitatively evaluated based on a natural angular frequency.

The above-mentioned construction machine may further include an adjusting unit for adjusting a dynamic characteristic of the work device based on a difference between the operation skill evaluation value estimated by the estimation unit and a preset index value.

With such a configuration, a dynamic characteristic of the work device is adjusted based on the difference between the operation skill evaluation value and the index value and hence, even an operator having a low skill level can operate the work device in the same manner as an operator having a high skill level thus performing the work efficiently.

In the above-mentioned construction machine, the index value may be changable according to an operation method or a work content.

With such a configuration, the index value can be changed according to the operation method or the work content and hence, the work device can be efficiently operated for various operations or works.

In the above-mentioned construction machine, the acquisition unit may measure or calculate the motion state amount.

With such a configuration, the motion state amount indicating the combined center of gravity of the plurality of members can be obtained by measurement or calculation.

An evaluation device according to another aspect of the present invention includes: an acquisition unit which acquires a motion state amount of a combined center of gravity of a plurality of members included in a work device of a construction machine; a forming unit which forms a transfer function which uses a driving force for moving the work device as an input and the motion state amount acquired by the acquisition unit as an output as an equivalent system which equivalently expresses an operation of the work device; and an estimation unit which estimates a system attenuation coefficient and a natural angular frequency of the transfer function formed by the forming unit as an operation skill evaluation value of an operator.

According to this configuration, the transfer function which uses a driving force for moving the work device including the plurality of members as an input and uses the motion state amount of the combined center of gravity of the plurality of members as an output is treated as the equivalent system which equivalently expresses the motion of the work device. Accordingly, the number of parameters expressing characteristics of the operation of operators can be reduced and hence, the operation skill of the operator can be easily evaluated. The characteristic amount of the operation of the operator can be obtained from system attenuation coefficient and the natural angular frequency of the transfer function and hence, the operation skill of the operator can be evaluated accurately. The attenuation characteristic which suppresses an overshoot speed can be quantitatively evaluated based on a system attenuation coefficient, and a speed responsiveness of the work can be quantitatively evaluated based on a natural angular frequency.

It should be noted that the specific embodiments or examples made in the section of the mode for carrying out the invention merely clarify the technical contents of the present invention, and the present invention is not limited to only such specific examples, and it should not be construed in a narrow sense, and can be modified and implemented within the scope of the spirit of the present invention and the claims.

The invention claimed is:

1. A construction machine comprising:

a lower travelling body;

an upper slewing body attached to the lower travelling body with a structure which allows the upper slewing body to slew with respect to the lower travelling body;

a work device which is attached to the upper slewing body with a structure which allows the work device to swing in a vertical direction with respect to the upper slewing body, and includes a plurality of members;

an acquisition unit includes sensors and acquires a motion state amount of a combined center of gravity of the plurality of members;

a forming unit including circuitry configured to from a transfer function, which uses a driving force for moving the work device as an input and uses the motion state amount acquired by the acquisition unit as an output, the transfer function being an equivalent system which equivalently expresses an operation of the work device; and an estimation unit including circuitry configured to estimate a system attenuation coefficient and a natural angular frequency of the transfer function formed by the forming unit as an operation skill evaluation value of an operator.

2. The construction machine according to claim 1, further comprising an adjusting unit including circuitry configured to adjust a dynamic characteristic of the work device based on a difference between the operation skill evaluation value estimated by the estimation unit and a preset index value.

3. The construction machine according to claim 2, wherein the index value is changeable according to an operation method or a work content.

4. The construction machine according to claim 1, wherein the acquisition unit measures or calculates the motion state amount.

5. An evaluation device comprising:

an acquisition unit includes sensors and acquires a motion state amount of a combined center of gravity of a plurality of members included in a work device of a construction machine;

a forming unit including circuitry configured to from a transfer function, which uses a driving force for moving the work device as an input and the motion state amount acquired by the acquisition unit as an output, the transfer function being an equivalent system which equivalently expresses an operation of the work device; and an estimation unit including circuitry configured to estimate a system attenuation coefficient and a natural angular frequency of the transfer function formed by the forming unit as an operation skill evaluation value of an operator.

* * * * *